US009151033B2

(12) United States Patent
Jarvis

(10) Patent No.: US 9,151,033 B2
(45) Date of Patent: Oct. 6, 2015

(54) AUTOMATICALLY RETRACTABLE SCREENS FOR STORM DRAIN CURB INLETS

(71) Applicant: Ernest Jarvis, Norco, CA (US)

(72) Inventor: Ernest Jarvis, Norco, CA (US)

( * ) Notice: Subject to any disclaimer, the term of this patent is extended or adjusted under 35 U.S.C. 154(b) by 235 days.

(21) Appl. No.: 14/051,447

(22) Filed: Oct. 11, 2013

(65) Prior Publication Data

US 2015/0101969 A1 Apr. 16, 2015

(51) Int. Cl.

| | |
|---|---|
| ***E03F 5/06*** | (2006.01) |
| ***E03F 5/04*** | (2006.01) |
| ***E03F 5/046*** | (2006.01) |

(52) U.S. Cl.

CPC ..... *E03F 5/0404* (2013.01); *E03F 5/046* (2013.01); *E03F 5/06* (2013.01); *E03F 2005/061* (2013.01); *E03F 2005/063* (2013.01)

(58) Field of Classification Search

CPC ..... E03F 5/0404; E03F 5/042; E03F 5/046; E03F 5/06; E03F 2005/061; E03F 2005/063

USPC ..... 210/131, 156, 162, 163, 170.03; 404/4, 404/5

See application file for complete search history.

(56) References Cited

U.S. PATENT DOCUMENTS

| | | | | |
|---|---|---|---|---|
| 6,217,756 | B1 * | 4/2001 | Martinez | 210/163 |
| 6,869,523 | B2 * | 3/2005 | Martinez | 210/156 |
| 7,467,911 | B2 | 12/2008 | Flury | |
| 7,491,338 | B2 | 2/2009 | Nino | |
| 7,951,291 | B2 | 5/2011 | Nino | |
| 8,277,645 | B2 | 10/2012 | Jarvis, Jr. et al. | |
| 2004/0151546 | A1 * | 8/2004 | Martinez | 210/170 |
| 2009/0236293 | A1 * | 9/2009 | Alvarado | 210/163 |
| 2013/0008842 | A1 | 1/2013 | Jarvis, Jr. et al. | |
| 2013/0008851 | A1 | 1/2013 | Jarvis, Jr. et al. | |
| 2015/0101971 | A1 * | 4/2015 | Jarvis | 210/154 |

* cited by examiner

*Primary Examiner* — Christopher Upton

(57) ABSTRACT

Embodiments of the invention provide automatically retractable screens, adapted for installation into a storm drain curb inlet, configured such that the automatically retractable screens are biased toward the closed position and thereby reliably closed during periods of no, low, or moderate surface runoff water flows, yet also reliably open when surface runoff water flow rates increase to moderate or high levels.

11 Claims, 8 Drawing Sheets

AUTOMATICALLY RETRACTABLE SCREENS FOR STORM DRAIN CURB INLETS

FIELD OF THE INVENTIONS

The present invention generally relates to storm drain curb inlet filters, and in particular to automatically retractable screen (ARS) storm drain inlet filters. Preferred ARSs of the invention have a positive bias toward the closed position.

BACKGROUND OF THE INVENTIONS

Primary functions of storm water conveyance systems include the prevention of erosion and flooding by channeling surface water runoffs into networks of underground pipes and/or open channels for controlled distribution. Surface water runoffs taken into storm water conveyance systems can be directed to water treatment facilities and/or open bodies of water, such as rivers, lakes, and oceans. Storm drains represent the intake point of surface water runoffs into the storm water conveyance system.

Surface water runoff enters a storm drain through an opening called a storm drain inlet. Typically, the storm drain inlet allows water to run into a catch basin. And the catch basins has an intake opening and an outlet pipe that provides a path for water to run from the catch basin into the remainder of the storm water conveyance system.

Debris removal is an important function of storm drain filtration systems because debris entering storm drains along with surface water runoff may clog storm drains, resulting in flooding, or run through storm drains, resulting in damage to water treatment facilities and/or pollution of receiving water bodies. Storm drains can incorporate a variety of filter systems designed to reduce the amount of debris that enters the storm drain and/or the storm water conveyance system. Examples of such filtering systems include storm drain inlet screens, catch basin filters, pre-treatment filters, and connector pipe screens.

While storm drain filtration systems should inhibit debris and trash from entering into the storm drain and/or storm water conveyance system, they should not interfere with the primary functions of the conveyance system, which is the prevention of erosion and flooding. One strategy for achieving these objectives are storm drain filtration systems comprising screens that occupy a closed position under dry conditions, or conditions of low or moderate water flow, and an open position under conditions of moderate to heavy water flow. In such systems, screens in the closed position impede the passage of debris while permitting low to moderate water flow; and screens in the open position allow the passage of debris and water such that the screens themselves do not plug the storm drains and cause flooding.

In the context of curb inlet filtration units, debris detained by such screens when there is no, low, or moderate water flow can be removed by a street sweeper, keeping the removed debris out the storm drain and the storm water conveyance system. In the context of connector pipe filtration units, debris detained by such screens when there is low to moderate water flow can be removed from the catch basin of the storm drain by maintenance crews, keeping the removed debris out of the remainder of the storm drain and/or storm water conveyance system.

A curb inlet filtration unit installed in a curbside drain opening which detains debris at no or low flow rates, but which opens when the rate of water flow is sufficiently high, is described in Jarvis U.S. Pat. No. 8,277,645. An inherent problem with known devices such as in the Jarvis patent is that the screen has an open configuration bias, such that the described curb inlet filtration unit has a high failure rate.

SUMMARY OF THE INVENTIONS

It is an object of this invention to provide an ARS, for use in a variety of storm drains, that is naturally and positively closed during periods of no, low, or moderate surface water runoff flow rates into storm drain inlets, and reliably open when such flow rates increase to moderate or high flow levels.

Certain embodiments of the invention provide ARSs, for a storm drain curb inlet, that comprise a first mounting bracket assembly, a second mounting bracket assembly, a front screen assembly, an actuator assembly, and a first control arm. Such ARSs have the following features. The front screen assembly: i. comprises a front screen having a substantially rectangular shape, a first front screen pivot, and a second front screen pivot, and ii. is swingably mounted between the first and second mounting bracket assemblies by the first and second front screen pivots. The actuator assembly: i. comprises a first actuator side plate, a second actuator side plate, an actuator bottom plate, an actuator back plate, a first actuator pivot, and a second actuator pivot, and ii. is swingably mounted between a first lateral side of the front screen and a second lateral side of the front screen by the first and second actuator pivots. The first control arm: i. comprises a substantially rectangular shape, a first control arm channel, and a first control arm pivot, and ii. is rotatably mounted on the first mounting bracket assembly by the first control arm pivot. A first control arm guide post is mounted on the first lateral side of the front screen. A first control arm lift post is mounted on the first actuator side plate. The first control arm channel comprises a first closed lock channel connected to a first main channel and is configured to slideably receive the first control arm guide post.

The ARS is configured to assume a closed lock position in which: i. the actuator back plate is substantially parallel to the front screen; ii. a front side of the actuator bottom plate abuts a bottom side of the front screen; iii. a bottom side of the first control arm rests on the first control arm lift post; and iv. the first control arm closed locked channel receives the first control arm guide post.

The ARS is configured such that, when in the closed lock position, an application of at least about 10 psi of pressure, in a frontward to rearward direction, to the actuator bottom plate causes the actuator assembly to swing on the first and second actuator pivots in a manner that causes the first control arm lift post to move in a rearward and upward direction and thereby rotate the first control arm on the first control arm pivot such that the first control arm guide post slides out of the first closed lock channel and into the first main channel, whereby the ARS achieves an initial unlocked position. And the ARS is configured such that, when in the initial unlocked position, an application of at least about 10 psi of pressure, in a frontward to rearward direction, to the front screen causes the front screen assembly to swing on the first and second front screen pivots into an open position.

In some embodiments, the ARSs further comprise a second control arm, a second control arm guide post, and a second control arm lift post. In such embodiments, the second control arm guide post is mounted on the second lateral side of the front screen. The second control arm lift post is mounted on the second actuator side plate. The second control arm: i. comprises a substantially rectangular shape, a second control arm channel, and a second control arm pivot, and ii. is rotatably mounted on the second mounting bracket assembly by the second control arm pivot. The second control arm channel comprises a second closed lock channel connected to a second main channel and is configured to slideably receive the second control arm guide post. The ARS is configured to assume a closed lock position in which a bottom side of the second control arm rests on the second control arm lift post and the second control arm closed locked channel receives the second control arm guide post. The ARS is configured such that, when in the closed lock position, an application of at least about 10 psi of pressure, in a frontward to rearward direction, to the actuator bottom plate causes the actuator assembly to swing on the first and second actuator pivots in a manner that causes the second control arm lift post to move in a rearward and upward direction and thereby rotate the second control arm on the second control arm pivot such that the second control arm guide post slides out of the second closed lock channel and into the second main channel, whereby the ARS achieves the initial unlocked position.

In some embodiments, the front screen assembly further comprises a first front screen pivot attachment member and a second front screen pivot attachment member. In such embodiments, the first front screen pivot attachment member attaches the first front screen pivot to the front screen such that: i. the first front screen pivot is positioned frontward of the front screen, and ii. at least a portion of a shaft of the first front screen pivot extends away from the front screen at a substantially right angle to the first lateral side of the front screen. The second front screen pivot attachment member attaches the second front screen pivot to the front screen such that: i. the second front screen pivot is positioned frontward of the front screen, and ii. at least a portion of a shaft of the second front screen pivot extends away from the front screen at a right angle to the second lateral side of the front screen. And a center of gravity of a combination comprising the actuator assembly mounted on the front screen assembly is located in a space that is frontward of a frontward surface of the front screen such that the front screen has a bias towards occupying a closed position.

In some embodiments, the first mounting bracket assembly comprises a substantially L-shaped structure formed by a first mounting bracket front plate attached to a first mounting bracket side plate. The first mounting bracket side plate comprises an opening for the first front screen pivot. A shaft of the first front screen pivot passes through the opening for the first front screen pivot. The second mounting bracket assembly comprises a substantially L-shaped structure formed by a second mounting bracket front plate attached to a second mounting bracket side plate. The second mounting bracket side plate comprises an opening for the second front screen pivot. And a shaft of the second front screen pivot passes through the opening for the second front screen pivot In some embodiments, the first lateral side of the front screen comprises an opening for the first actuator pivot. The second lateral side of the front screen comprises an opening for the second actuator pivot. A shaft of the first actuator pivot extends away from the first actuator side plate at a substantially right angle. A shaft of the second actuator pivot extends away from the second actuator side plate at a substantially right angle. A section of the shaft of the first actuator pivot passes through the opening for the first actuator pivot. And a section of the shaft of the second actuator pivot passes through the opening for the second actuator pivot.

In some embodiments the ARS further comprises a protection bar that is fixedly attached to each of the first and second mounting bracket assemblies.

In some embodiments, the first control arm further comprises a first manual lock channel connected to the first main channel.

In some embodiments, the ARS further comprises a first mounting bracket support member fixedly coupled to the first mounting bracket front plate and a second mounting bracket support member fixedly coupled to the second mounting bracket front plate.

In some embodiments, the ARS is made of stainless steel.

In some embodiments, the front screen comprises a plurality of perforations having a diameter of at least ½ inch.

In some embodiments, a top side of the front screen comprises a front screen top plate, and wherein the front screen top plate comprises top plate overflow channels.

DETAILED DESCRIPTION OF THE INVENTIONS

Figure 1A:
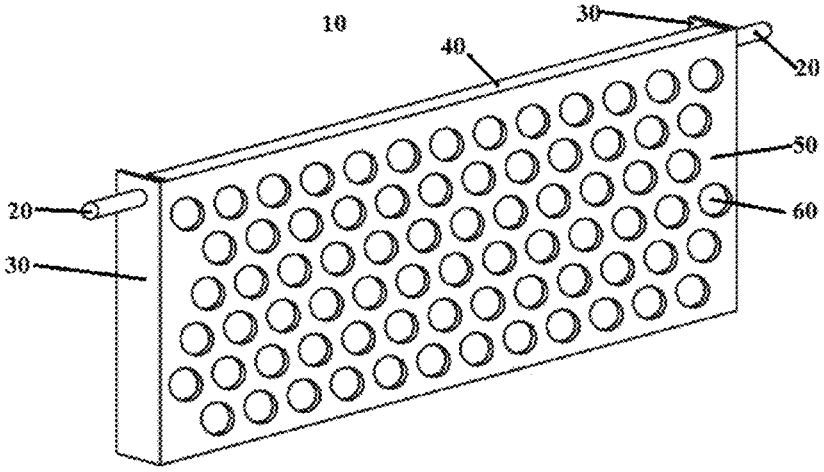
FIG. 1A is a front elevation view of a prior art curb inlet hanging screen.
Figure 1B:
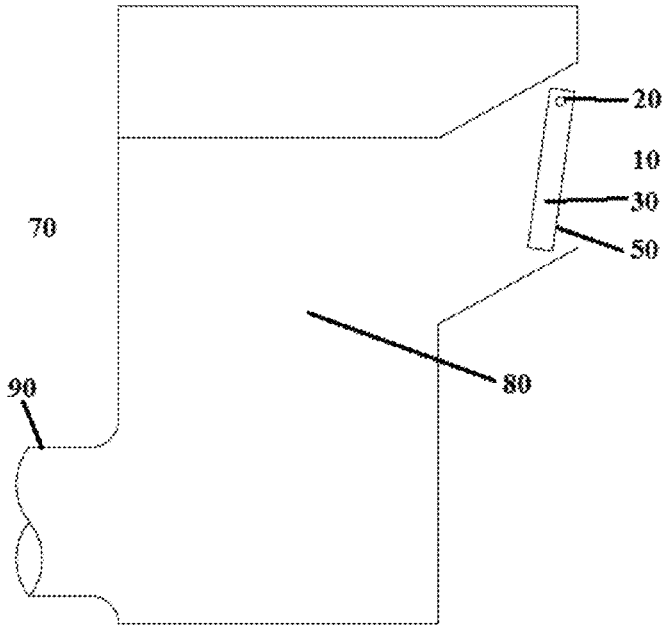
PRIOR ART Figure 1B
FIG. 1B is a side view of a storm drain with the prior art curb inlet hanging screen illustrated in FIG. 1A installed in a storm drain.

FIG. 1A is a front elevation view of a prior art curb inlet hanging screen 10 that comprises hanging pivots 20, side plates 30, top plate 40, front screen 50, and front screen perforations 60. Prior art curb inlet screen 10 is made of metal, such as steel or stainless steel. FIG. 1B is a side view of a storm drain 70 that comprises prior art curb inlet screen 10, a catch basin 80, and a connector pipe 90. Prior art curb inlet screen 10 is moveably mounted in storm drain 70 by hanging pivots 20. A majority of the weight of prior art curb inlet screen 10 resides in front screen 50 and hanging pivots 20 are positioned rearward of front screen 50 (FIG. 1A). Accordingly, the center of gravity of prior art curb inlet screen 10 is located between front screen 50 and a plane that runs parallel to a broad face of front screen 50 and that bisects hanging pivots 20.

The combination of having a so-located center of gravity and being moveably mounted in storm drain 70 results in prior art curb inlet screen 10 having a bias toward an open position when mounted in a hanging fashion into storm drain 70, as shown in FIG. 1B. Such an open position bias results in prior art curb inlet screen 10 having a tendency to open under any conditions, including dry conditions or conditions of low to moderate water flow through the curb inlet screen. In an open position, debris is free to enter storm drain 70, rendering curb inlet screen 10 non-operative for its intended filtering function.

Figure 2:
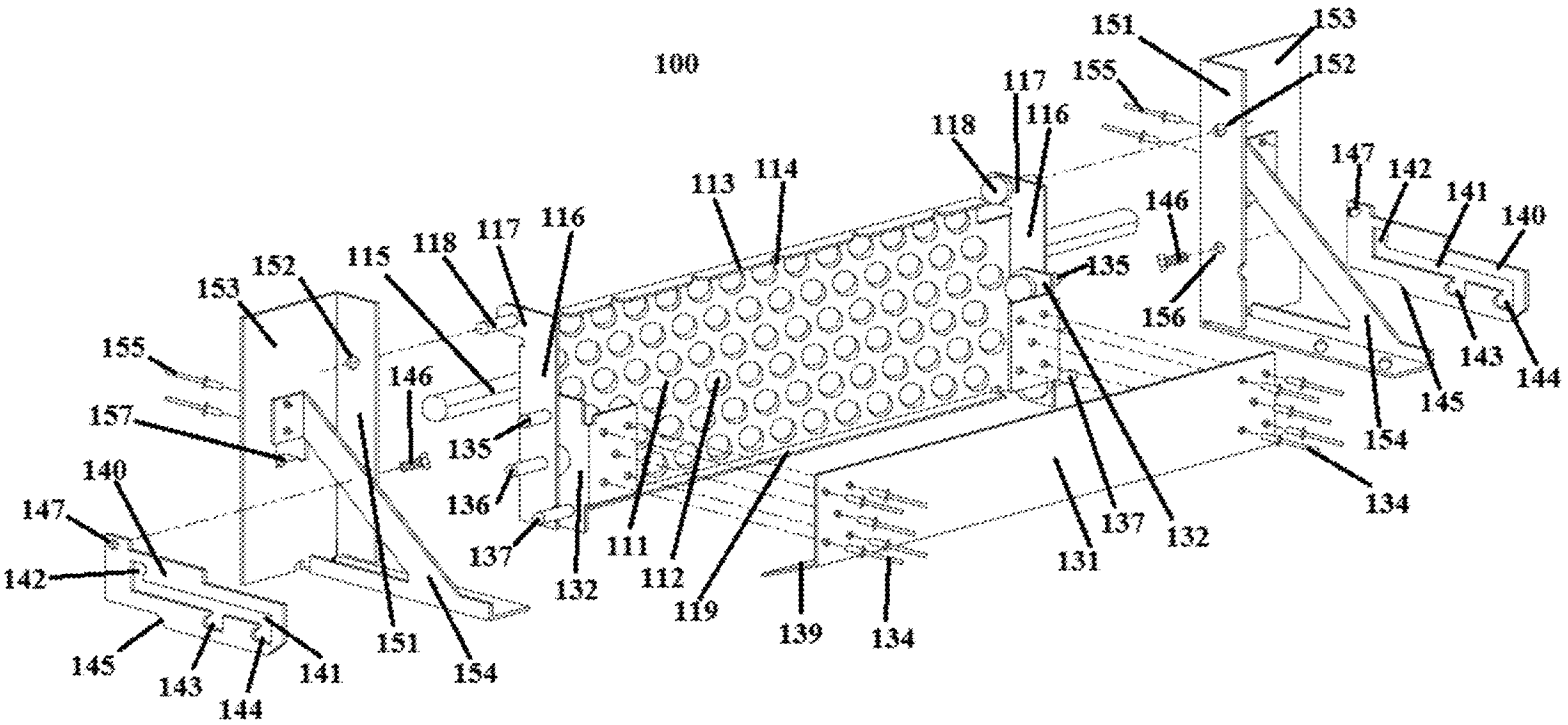
FIG. 2 is an exploded view of an ARS according to the present invention.

FIG. 2 is an exploded view of an ARS 100 according to the present invention. ARS 100 comprises front screen 111, front screen top plate 113, front screen side plates 116, front screen pivot mounting plates 117, and front screen bottom plate 119, which form a front screen assembly. Front screen 111 comprises front screen perforations 112 that are adapted to allow surface water runoff to pass through the front screen and impede particulate matter having a diameter, width, or length greater than the diameter of front screen perforations 112 from being carried through front screen 111 by surface water runoff. Front screen top plate 113 comprises front screen top plate overflow channels 114, configured to direct surface water runoff passing over the top of front screen top plate 113 downward onto actuator bottom plate 139 when ARS 100 is assembled (not shown).

ARS 100 comprises actuator back plate 131, actuator side plates 132, actuator bottom plate 139, actuator hanging pivots 135, control arm guide posts 136, and control arm lift post 137, which are configured to form an actuator assembly. Actuator rivets 134 are configured for fixedly attaching each end of actuator back plate 131 to the back flanges of actuator side plates 132. In some embodiments, the back flanges of actuator side plates 132 are fixedly attached not by rivets, but by weld(s), bracket(s), screw(s), hinges(s), and the like. Referring again to FIG. 2, the actuator assembly is configured for rotatable mounting onto the front screen assembly by the positioning of actuator hanging pivots 135 through actuator hanging pivot openings in front screen side plates 116.

ARS 100 further comprises right and left mounting bracket assemblies, each of which comprises a mounting bracket side plate 151 having a front screen hanging pivot opening 152, a mounting bracket front plate 153, and a mounting bracket support member 154. Mounting bracket support member rivets 155 are adapted for fixedly attaching bracket support members 154 to mounting bracket front plates 153. The front screen assembly is configured for rotatable mounting onto the mounting bracket assemblies by the positioning of front screen hanging pivots 118 through front screen hanging pivot openings 152 in mounting bracket side plates 151.

ARS 100 further comprises right and left control arms 140, each of which comprises a control arm guide post main channel 141, a control arm guide post closed lock channel 142, a control arm guide post first manual lock channel 143, a control arm guide post second manual lock channel 144, a control arm lifter edge 145, and a control arm pivot opening 147. Control arms 140 are configured for rotatable mounting onto mounting bracket side plates 151, by the positioning of control arm hanging pivots 146 through mounting bracket control arm pivot openings 156 and control arm pivot openings 147. Control arm guide post main channels 141, control arm guide post closed lock channels 142, control arm guide post first manual lock channels 143, and control arm guide post second manual lock channels 144 are configured to slideably receive control arm guide posts 136. Control arm lift posts 137 are configured to abut the frontward end of control arm lifter edge 145 when control arm guide post closed lock channels 142 receive control arm guide posts 136 in an assembled ARS 100.

Figure 3A:
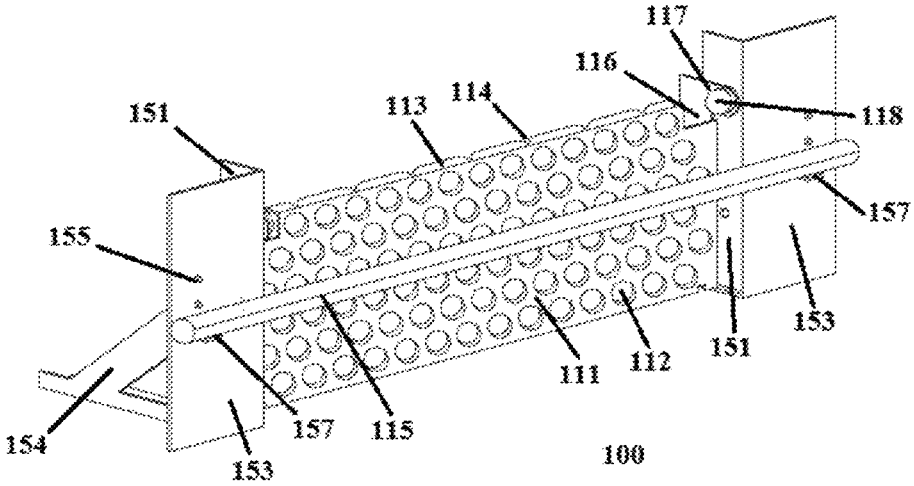
FIG. 3A is a front elevation view of the ARS illustrated in FIG. 2, in assembled form.

FIG. 3A is a front elevation view of the ARS illustrated in FIG. 2, in assembled form. Illustrated in FIG. 3A are front screen top plate 113 comprising top plate overflow channels 114, front screen side plate 116, front screen pivot mounting plates 117, and front screen 111 comprising perforations 112, all of which are formed from a single sheet of metal cut and bent into the illustrated form. In some ARS embodiments according to the present invention, front screen top plates, side plates, bottom plates, and/or pivot mounting plates are formed into configurations the same or substantially similar to that illustrated in FIG. 3A not by bending a single piece of metal, but rather by joining together two or more sheets of metal, which have been cut, filed, molded, sanded, bent, etc. into subcomponent parts, by weld(s), bracket(s), screw(s), pivot(s), rivet(s), and the like.

Referring again to FIG. 3A, also illustrated are right and left mounting bracket assemblies, each of which comprise a mounting bracket side plate 151 and a mounting bracket front plate 153, together with a protection bar mount cutout 157 and a mounting bracket support member 154 fixedly coupled thereto by mounting bracket support member rivets 155. Protection bar 115 is fixedly attached to protection bar mount cutouts 157 of each mounting bracket assembly. So attached and positioned. protection bar 115 provides increased structural strength to ARS 100 and impact protection to front screen 111.

The mounting bracket side plate, the mounting bracket front plate, and the protection bar mount cutout of each mounting bracket assembly are formed from a single sheet of metal cut and bent into the illustrated form; as is the mounting bracket support member. In some ARS embodiments according to the present invention, mounting bracket side plates, mounting bracket front plates, protection bar mounts, and/or mounting bracket support members are formed into configurations the same or substantially similar to those illustrated in FIG. 3A not by cutting and/or bending a single piece of metal, but rather by joining together two or more sheets of metal, which have been cut, filed, sanded, bent, etc. into subcomponent parts, by weld(s), bracket(s), screw(s), hinges(s), rivet(s), and the like. In some embodiments, mounting protection bars are fixedly attached to mounting bracket assemblies by weld, brackets, bolts, screws and the like. In some embodiments, protection bars are fixedly attached directly to mounting bracket front plates.

Figure 3B:
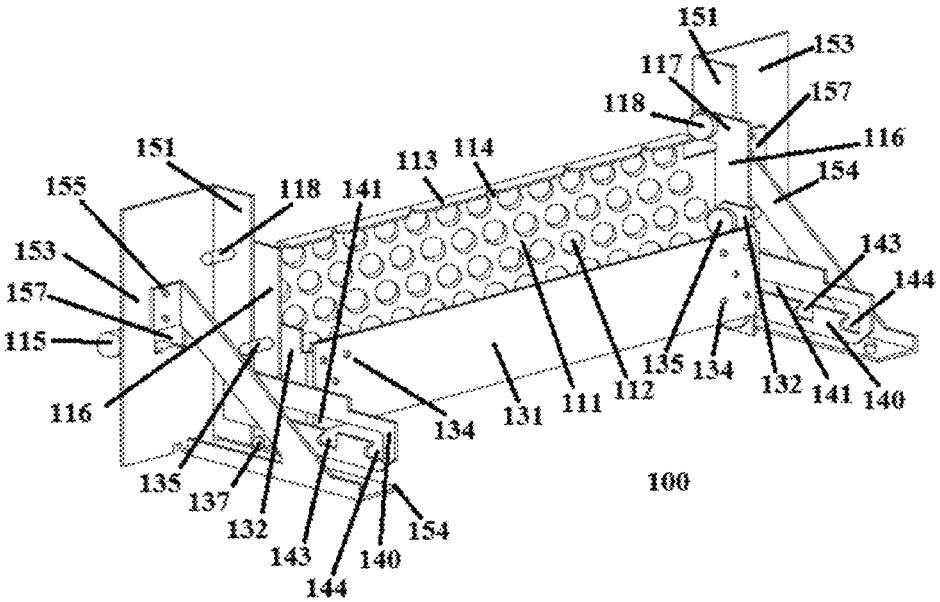
FIG. 3B is a rear elevation view of the ARS illustrated in FIG. 2, in assembled form.

FIG. 3B is a rear elevation view of the ARS illustrated in FIG. 2, in assembled form. Illustrated in FIG. 3B are front screen top plate 113 comprising top plate overflow channels 114, front screen side plates 116, front screen pivot mounting plates 117, front screen hanging pivots 118, and front screen 111 comprising perforations 112, which form a front screen assembly.

Actuator back plate rivets 134 are adapted for fastening actuator back plate 131 to the rearward flanges of actuator side plates 132. Actuator bottom plate 139 (see FIG. 2) and actuator back plate 131 are formed from a single bent sheet of metal. Control arm guide posts 136 are mounted on front screen side plates 116, and control arm lift posts 137 are mounted on actuator side plates 132. These actuator components form an actuator assembly that is rotatably mounted onto the front screen assembly by the positioning of actuator hanging pivots 135 through actuator hanging pivot openings in front screen sides plates 116.

In some embodiments, actuator side plates and their rearward flanges are formed from one piece of metal by bending. In some embodiments actuator side plates and their rearward flanges are formed into configurations the same or substantially similar to those illustrated in FIG. 3B from two or more subcomponent parts joined together by weld(s), bracket(s), screw(s), hinges(s), rivet(s), and the like. In some embodiments, actuator bottom plate 139 (see FIG. 2) and actuator back plate 131 are formed into configurations the same or substantially similar to those illustrated in FIG. 3B from two or more subcomponent parts joined together by weld(s), bracket(s), screw(s), hinges(s), rivet(s), and the like.

Referring again to FIG. 3B, a majority of the weight of the actuator assembly lies rearward of the actuator hanging pivots 135. Accordingly, the center of gravity of the actuator assembly lies rearward of actuator hanging pivots 135. The positioning of actuator hanging pivots 135 frontward of the center of gravity of the actuator assembly results in actuator back plate 131 having a bias toward occupying a closed position. In the closed position, the frontward edge of actuator bottom plate 139 (see FIG. 2) abuts front screen 111 slightly above front screen bottom plate 119 (see FIG. 5A). Also in the closed position, control arm lift posts 137 abut both the rearward edges of front screen side plates 116 and the frontward ends of control arm lifter edges 145 (see FIG. 5A); and control arms 140 rest on control arm lift posts 137. This configuration of control arm lifter posts 137 and control arms 140 reversibly secures the actuator assembly in a closed position. Accordingly, ARSs of the present invention can comprise actuator assemblies having, to a certain extent, a center of gravity even with or slightly frontward of actuator hanging pivots 135, not exceeding the extent to which the pressure of control arms 140 resting on control arm lifter posts 137 reversibly secure the actuator assembly in a closed position.

Referring again to FIG. 3B, it illustrates right and left mounting bracket assemblies, each of which comprises a mounting bracket side plate 151 and a mounting bracket front plate 153 having a protection bar mount 157 cutout therefrom and a mounting bracket support member 154 fixedly coupled thereto by mounting bracket support member rivets 155. The front screen assembly is rotatably mounted onto the mounting bracket assemblies by the positioning of front screen hanging pivots 118 through front screen hanging pivot openings in mounting bracket side plates 151.

A majority of the weight of the front screen assembly and all of the weight of the actuator assembly mounted thereon lies rearward of front screen 111. Accordingly, the center of gravity of the combination of the front screen assembly and the actuator assembly lies rearward of the front screen hanging pivots 118. The positioning of front screen hanging pivots 118 frontward of the center of gravity of the combination of the front screen assembly and the actuator assembly results in the front screen 111 having a bias towards occupying a closed position. ARS 100 is therefore reliably operative for its intended filtering function.

Referring again to FIG. 3B, it illustrates right and left control arms 140. Control arms 140 are rotatably mounted onto mounting bracket side plate 151 by the positioning of control arm hanging pivots 146 through control arm pivot openings 147 in control arms 140 (see FIG. 5A) and control arm pivot openings 156 in mounting bracket side plates 151 (see FIG. 2). In FIG. 3B, ARS 100 is in a closed lock position. Accordingly, control arm lift posts 137 are positioned at the frontward end of control arm lifter edges 145 (see FIG. 5A) and control arm guide posts 136 occupy the guide post closed lock channels 142 (see FIG. 5A).

Figure 4:
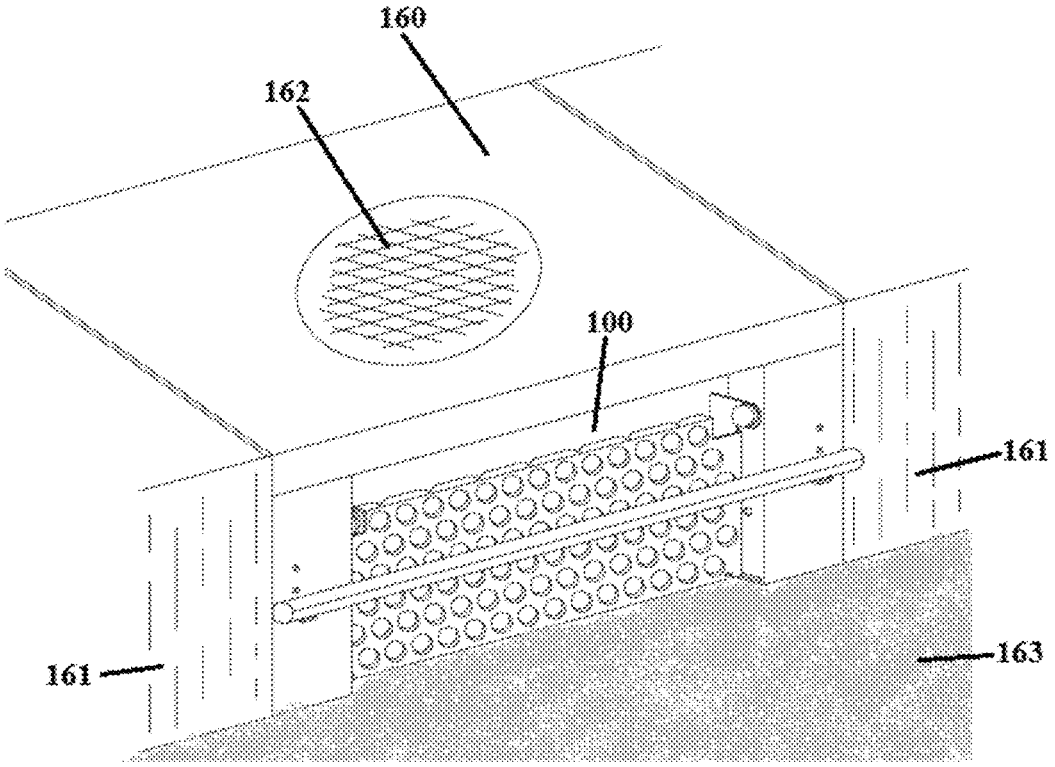
FIG. 4 is a front elevation view of the ARS illustrated in FIG. 3 installed in a storm drain curb inlet.

FIG. 4 is an elevated view of the ARS 100 illustrated in FIG. 2 assembled and installed into a storm drain inlet opening in curb 161 adjacent roadway 163 and under sidewalk 160 and manhole cover 162.

Figure 5A:
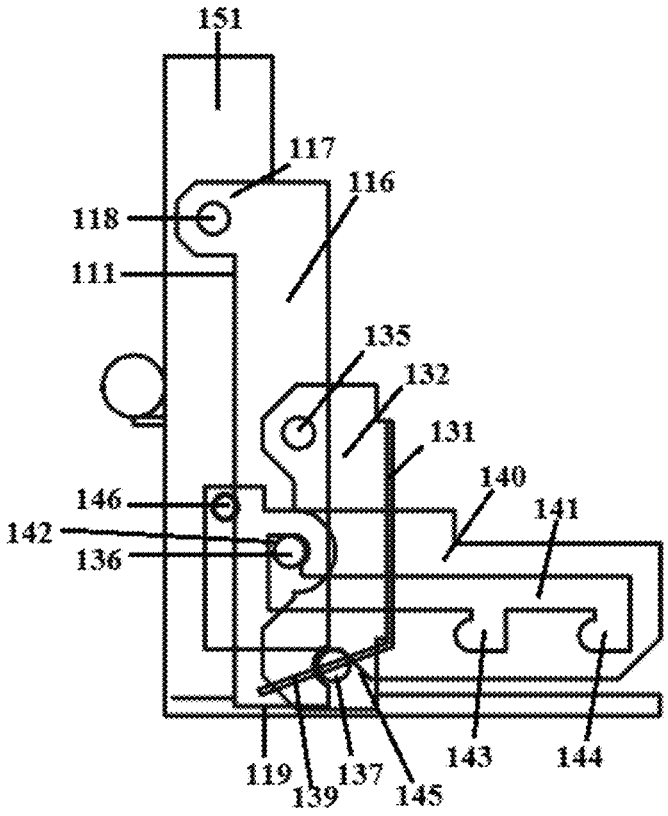
FIG. 5A is a side view of the control arm, actuator assembly, and front screen assembly of the ARS illustrated in FIG. 3 in a closed lock position.

FIG. 5A is side view of an actuator assembly, a front screen assembly, and a control arm of the ARS illustrated in FIG. 3 in a closed lock position. In the closed lock position, control arm guide post 136 occupies its closed lock guide post channel 142 and supports control arm 140, which has a substantially rectangular shape and is rotatably mounted on control arm hanging pivot 146 by the placement of control arm hanging pivot 146 through the opening therefor in mounting bracket side plate 151. The frontward edge of actuator bottom plate 139 abuts front screen 111 slightly above front screen bottom plate 119. Control arm lift post 137 abuts the frontward end of control arm lifter edge 145 and the rearward edge of side plate 116. The actuator assembly is rotatably mounted on actuator hanging pivot 135 by the placement of actuator hanging pivot 135 through the opening therefor in front screen side plate 116. The front screen assembly is rotatably mounted onto mounting bracket side plate 151 by the placement of front screen mounting pivot 118 through openings therefor in front screen mount plate 117 and mounting bracket side plate 151. Control arm guide post 136 does not have access to guide post main channel 141 because it is stably positioned in guide post closed lock channel 142. Accordingly, front screen 111 stably occupies a closed position, even when sustaining forceful impacts from a frontward direction that do not also impact actuator back plate 131 and/or actuator bottom plate 139.

Figure 5B:
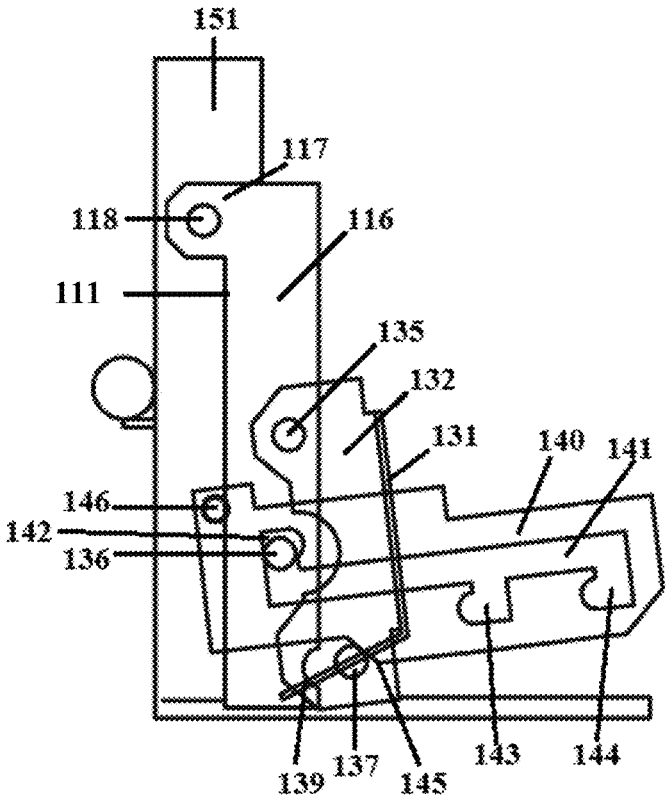
FIG. 5B is a side view of the ARS components illustrated in FIG. 5A in an initial unlocking position.

FIG. 5B is a side view of the ARS components illustrated in FIG. 5A, in an initial unlocking position. The illustrated position is achieved by the application of an amount of pressure, from a frontward to rearward direction, on actuator back plate 131 and/or actuator bottom plate 139 sufficient to cause the actuator assembly to rotate around actuator hanging pivot 135, which in turn causes control arm lift post 137 to move in a rearward and upward direction. Such motion by control arm lift post 137 is accompanied by its application of pressure on control arm lifter edge 145 that causes control arm 140 to rotate around control arm hanging pivot 146 in a manner that results in guide post closed lock channel 142 sliding upward relative to control arm guide post 136. Pressure required to achieve the initial unlocking position illustrated in FIG. 3B can be exerted by water flowing through an ARS installed in a storm drain curb inlet. Such pressures are customizable by, for instance and without illustration, manipulating weights of the control arm and actuator assembly components and/or the positioning of the actuator hanging pivots and the control arm hanging pivots. Such pressures useful in connection with ARSs of the invention include at least about 5 psi, at least about 10 psi, about 14 psi, about 20 psi, and about 25 psi.

Figure 5C:
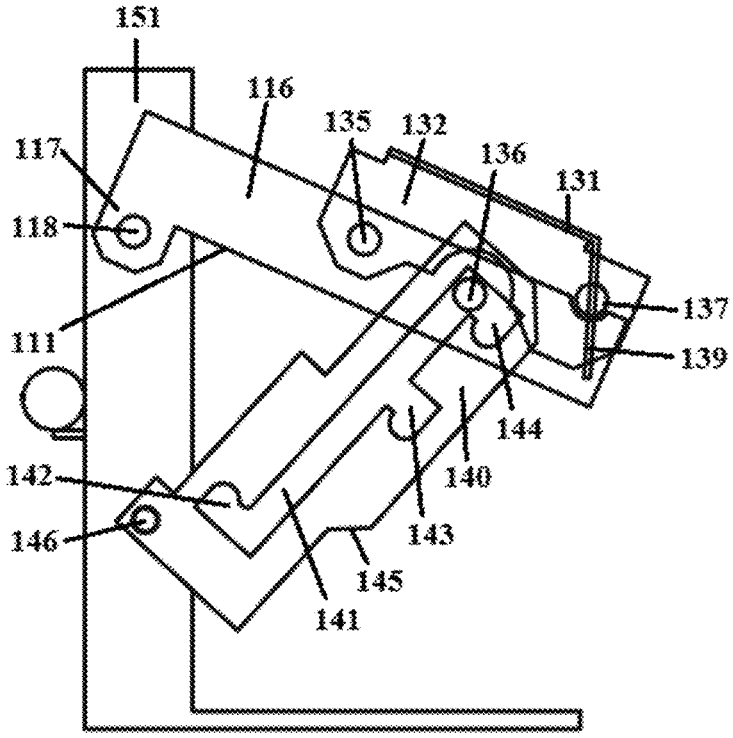
FIG. 5C is a side view of the ARS components illustrated in FIG. 5A in a water unlocked position.

The application of sufficient additional frontward to rearward pressure on actuator back plate 131 and/or actuator bottom plate 139 will cause guide post close lock channel 142 to slide further upward relative to control arm guide post 136 such that control arm guide post 136 is positioned entirely at the frontward end of guide post main channel 141 (not shown). When control arm guide post 136 is in the instantly described position it is unlocked such that application of pressure, from a frontward to rearward direction on front screen 111, sufficient to overcome the bias of the front screen 111 to occupy the closed position will cause front screen 111 to rotate around front screen hanging pivots 118 into an open position. Such rotation by front screen 111 results in control arm guide post 136 sliding to a rearward position in guide post main channel 141 (see FIG. 5C). The particular front screen open position illustrated in FIG. 5C is its maximum open position since control arm guide post 136 is abutting the rearward end of guide post main channel 141.

In an ARS installed in a storm drain, the described frontward to rearward pressures are typically applied to the actuator back plate, the actuator bottom plate, and/or the front screen by surface water runoff or by storm drain maintenance crews.

Figure 5D:
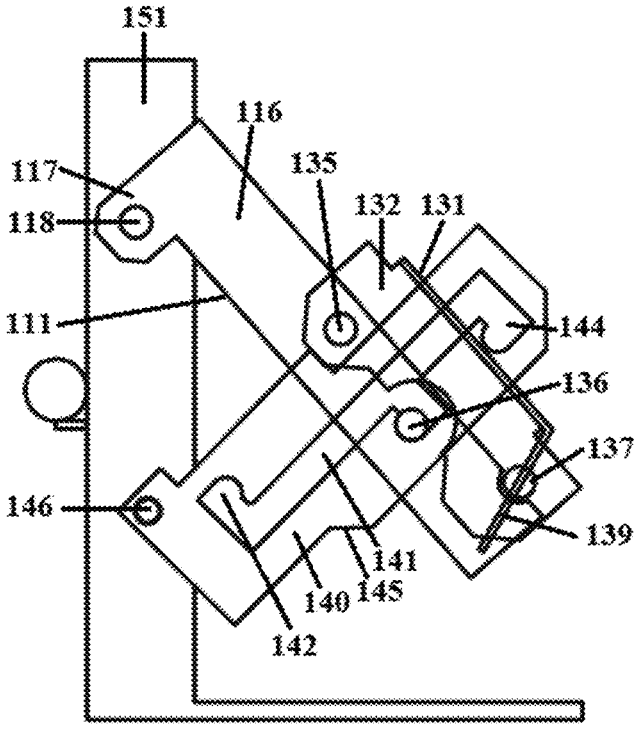
FIG. 5D is a side view of the ARS components illustrated in FIG. 5A in a manual locked position.

FIG. 5D is a side view of the ARS components illustrated in FIG. 5A, in a first manual lock position. This position is typically achieved by a maintenance worker first applying to actuator bottom plate 139 and/or actuator back plate 131 the above-described unlocking pressure and then applying a sufficient amount of frontward to rearward directed pressure on front screen 111 to position control arm guide post 136 in guide post main channel 141 just above first manual lock channel 143. The worker then rotates control arm 140 around control harm hanging pivot 146 such that control arm guide post 136 slides into first manual lock channel 143. The worker then releases the frontward to rearward directed pressure on front screen 111 to achieve the first manual lock position. The ARS can be released from the first manual lock position by application of frontward to rearward directed pressure on front screen 111 control arm guide post slides out of first manual lock channel 143 into guide post main channel 141. The worker then stops applying pressure on front screen 111 and the ARS returns to its closed lock position.

Storm drain ARSs of the present invention are customizable with respect to size and shape in order to achieve the desired performance of a particular function (e.g., amounts of water flow at which an ARS will unlock and open) and to fit a particular storm drain. In addition, ARSs may be fabricated to include any metal. alloy, and the like that confers sufficient strength upon the resistance hanging screen to perform its intended function. Useful metals include steel, such as galvanized steel and stainless steel.

Storm drain resistance hanging screens of the invention comprise perforations that allow water to flow therethrough. Perforations may be of any functional shape, such as circular, oval, square, diamond, rectangular, triangular, and the like. In addition, perforations may be of any size suitable for the resistance hanging screen to achieve its intended function of impeding debris from entering storm drains and/or the downstream sewer system while at the same time assisting storm drains in achieving their primary purposes of preventing erosion and flood control. In some embodiments, substantially evenly spaced front screen perforations having diameters ranging from approximately ½ inch to ¾ inch cover approximately 30%, 40%, 50%, or 60% of the front screen.

In some embodiments, an ARS is fastened to the storm drain inlet so that its side mounting brackets arc flush with the curb surrounding the storm drain inlet.

Pivots useful in storm ARSs of the invention include bolts, rods, pins, and commercial hardware such as Buckeye pins.

The degree to which an ARS of the invention is biased towards a closed position is customizable by, for instance and without limitation, manipulating the weight of the front screen and/or the distance the front screen hanging pivots are positioned frontward of its center of gravity. Useful biases toward the closed position for front screens of ARSs of the invention include those in which a front screen of an ARS of the invention maintains a closed position until subjected to a pressure, from a frontward to rearward direction, of at least about 10 psi, about 14 psi, about 20 psi, and about 25 psi, e.g. by water passing through the front screen. Upon exposure to such pressures, the front screen will swing on its hanging pivots into an open position, the degree of openness increasing with increasing water flow. Upon abatement of such water flows the front screen will swing with bias on its hanging pivots into the closed position.

The skilled artisan will recognize the interchangeability of various features from different embodiments. Although the disclosure has been provided in the context of certain embodiments and examples, it will be understood by those skilled in the art that the disclosure extends beyond the specifically described embodiments to other alternative embodiments and/or uses and obvious modifications and equivalents thereof. Accordingly, the disclosure is not intended to be limited by the specific disclosures of embodiments herein.

What is claimed is:

1. An automatically retractable screen (ARS), for a storm drain curb inlet, comprising a first mounting bracket assembly, a second mounting bracket assembly, a front screen assembly, an actuator assembly, and a first control arm, wherein:

the front screen assembly: i. comprises a front screen having a substantially rectangular shape, a first front screen pivot, and a second front screen pivot, and ii. is swingably mounted between the first and second mounting bracket assemblies by the first and second front screen pivots;

the actuator assembly: i. comprises a first actuator side plate, a second actuator side plate, an actuator bottom plate, an actuator back plate, a first actuator pivot, and a second actuator pivot, and ii. is swingably mounted between a first lateral side of the front screen and a second lateral side of the front screen by the first and second actuator pivots;

the first control arm: i. comprises a substantially rectangular shape, a first control arm channel, and a first control arm pivot, and ii. is rotatably mounted on the first mounting bracket assembly by the first control arm pivot;

a first control arm guide post is mounted on the first lateral side of the front screen;

a first control arm lift post is mounted on the first actuator side plate;

the first control arm channel comprises a first closed lock channel connected to a first main channel and is configured to slideably receive the first control arm guide post;

the ARS is configured to assume a closed lock position in which: i. the actuator back plate is substantially parallel to the front screen; ii. a front side of the actuator bottom plate abuts a bottom side of the front screen; iii. a bottom side of the first control arm rests on the first control arm lift post; and iv. the first control arm closed locked channel receives the first control arm guide post;

the ARS is configured such that, when in the closed lock position, an application of at least about 10 psi of pressure, in a frontward to rearward direction, to the actuator bottom plate causes the actuator assembly to swing on the first and second actuator pivots in a manner that causes the first control arm lift post to move in a rearward and upward direction and thereby rotate the first control arm on the first control arm pivot such that the first control arm guide post slides out of the first closed lock channel and into the first main channel, whereby the ARS achieves an initial unlocked position; and the ARS is configured such that, when in the initial unlocked position, an application of at least about 10 psi of pressure, in a frontward to rearward direction, to the front screen causes the front screen assembly to swing on the first and second front screen pivots into an open position.

2. The ARS of claim 1, further comprising a second control arm, a second control arm guide post, and a second control arm lift post, wherein:

the second control arm guide post is mounted on the second lateral side of the front screen;

the second control arm lift post is mounted on the second actuator side plate;

the second control arm: i. comprises a substantially rectangular shape, a second control arm channel, and a second control arm pivot, and ii. is rotatably mounted on the second mounting bracket assembly by the second control arm pivot;

the second control arm channel comprises a second closed lock channel connected to a second main channel and is configured to slideably receive the second control arm guide post;

the ARS is configured to assume a closed lock position in which a bottom side of the second control arm rests on the second control arm lift post and the second control arm closed locked channel receives the second control arm guide post;

the ARS is configured such that, when in the closed lock position, an application of at least about 10 psi of pressure, in a frontward to rearward direction, to the actuator bottom plate causes the actuator assembly to swing on the first and second actuator pivots in a manner that causes the second control arm lift post to move in a rearward and upward direction and thereby rotate the second control arm on the second control arm pivot such that the second control arm guide post slides out of the second closed lock channel and into the second main channel, whereby the ARS achieves the initial unlocked position.

3. The ARS of claim 1, wherein the front screen assembly further comprises a first front screen pivot attachment member and a second front screen pivot attachment member, and wherein:

the first front screen pivot attachment member attaches the first front screen pivot to the front screen such that: i. the first front screen pivot is positioned frontward of the front screen, and ii. at least a portion of a shaft of the first front screen pivot extends away from the front screen at a substantially right angle to the first lateral side of the front screen;

the second front screen pivot attachment member attaches the second front screen pivot to the front screen such that: i. the second front screen pivot is positioned frontward of the front screen, and ii. at least a portion of a shaft of the second front screen pivot extends away from the front screen at a right angle to the second lateral side of the front screen; and a center of gravity of a combination comprising the actuator assembly mounted on the front screen assembly is located in a space that is frontward of a frontward surface of the front screen such that the front screen has a bias towards occupying a closed position.

4. The ARS of claim 3, wherein the first mounting bracket assembly comprises a substantially L-shaped structure formed by a first mounting bracket front plate attached to a first mounting bracket side plate, and wherein the first mounting bracket side plate comprises an opening for the first front screen pivot, and wherein a shaft of the first front screen pivot passes through the opening for the first front screen pivot, and wherein the second mounting bracket assembly comprises a substantially L-shaped structure formed by a second mounting bracket front plate attached to a second mounting bracket side plate, and wherein the second mounting bracket side plate comprises an opening for the second front screen pivot, and wherein a shaft of the second front screen pivot passes through the opening for the second front screen pivot.

5. The ARS of claim 4, wherein the first lateral side of the front screen comprises an opening for the first actuator pivot, and wherein the second lateral side of the front screen comprises an opening for the second actuator pivot, and wherein a shaft of the first actuator pivot extends away from the first actuator side plate at a substantially right angle, and wherein a shaft of the second actuator pivot extends away from the second actuator side plate at a substantially right angle, and wherein a section of the shaft of the first actuator pivot passes through the opening for the first actuator pivot, and wherein a section of the shaft of the second actuator pivot passes through the opening for the second actuator pivot.

6. The ARS of claim 5, further comprising a protection bar that is fixedly attached to each of the first and second mounting bracket assemblies.

7. The ARS of claim 5, wherein the first control arm further comprises a first manual lock channel connected to the first main channel.

8. The ARS of claim 5, further comprising a first mounting bracket support member fixedly coupled to the first mounting bracket front plate and a second mounting bracket support member fixedly coupled to the second mounting bracket front plate.

9. The ARS of claim 5, wherein the ARS is made of stainless steel.

10. The ARS of claim 5, wherein the front screen comprises a plurality of perforations having a diameter of at least ½ inch.

11. The automatically retractable screen of claim 5, wherein a top side of the front screen comprises a front screen top plate, and wherein the front screen top plate comprises top plate overflow channels.

* * * * *